US009187280B2

(12) United States Patent
Nishii et al.

(10) Patent No.: US 9,187,280 B2
(45) Date of Patent: Nov. 17, 2015

(54) SHEET FEEDING DEVICE, CONTROL METHOD FOR THE SHEET FEEDING DEVICE, AND IMAGE FORMING APPARATUS INCORPORATING THE SHEET FEEDING DEVICE

(75) Inventors: Toshikane Nishii, Osaka (JP); Hiroshi Fujiwara, Osaka (JP); Tomoyoshi Yamazaki, Tokyo (JP); Haruyuki Honda, Osaka (JP); Mizuna Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 281 days.

(21) Appl. No.: 13/313,786

(22) Filed: Dec. 7, 2011

(65) Prior Publication Data

US 2012/0146281 A1 Jun. 14, 2012

(30) Foreign Application Priority Data

Dec. 10, 2010 (JP) ..... 2010-275927

(51) Int. Cl.

*B65H 7/02* (2006.01)
*B65H 9/00* (2006.01)
*B65H 7/04* (2006.01)

(Continued)

(52) U.S. Cl.

CPC ..... *B65H 9/006* (2013.01); *B65H 7/02* (2013.01); *B65H 7/04* (2013.01); *B65H 7/06* (2013.01); *B65H 7/14* (2013.01); *B65H 7/18* (2013.01); *B65H 2511/51* (2013.01); *B65H 2511/514* (2013.01); *B65H 2511/515* (2013.01); *B65H 2511/52* (2013.01); *B65H 2513/511* (2013.01); *B65H 2513/512* (2013.01); *B65H 2513/514* (2013.01); *B65H 2513/53* (2013.01); *B65H 2553/412* (2013.01);

(Continued)

(58) Field of Classification Search

CPC ..... B65H 3/00; B65H 5/00; B65H 7/02; B65H 7/04; B65H 7/06; B65H 7/14; B65H 2553/00; B65H 2553/60; B65H 2553/61; B65H 2553/612; B65H 2553/614; B65H 2511/528; B65H 2601/11; B65H 2601/255; B65H 9/006; B65H 2511/515; B65H 2511/52; B65H 2511/53; B65H 2511/51; B65H 2513/512; B65H 2513/514

USPC ..... 271/4.03, 10.03, 265.01, 265.02

See application file for complete search history.

(56) References Cited

U.S. PATENT DOCUMENTS 6,105,954 A * 8/2000 Magee et al. ..... 271/10.03
6,381,441 B1 * 4/2002 Byeon et al. ..... 399/396

(Continued)

FOREIGN PATENT DOCUMENTS

JP 61178732 11/1986
JP 06271151 A 9/1994

(Continued)

*Primary Examiner* — Prasad Gokhale

(74) *Attorney, Agent, or Firm* — Harness, Dickey & Pierce, P.L.C.

(57) ABSTRACT

A sheet feeding device includes a feeding device and a detector. The feeding device is configured to feed a sheet to a destination. The detector is configured to detect the sheet at the destination. If the detector does not detect the sheet within a predetermined time after the start of preparation for a feeding operation by the feeding device, it is determined that the sheet is misfed. Further, the start of the feeding operation of a sheet is changed in accordance with the result of detection by the detector of the presence or absence of a sheet standing by at the destination.

13 Claims, 6 Drawing Sheets

(51) Int. Cl.
*B65H 7/06* (2006.01)
*B65H 7/14* (2006.01)
*B65H 7/18* (2006.01)

(52) U.S. Cl.
CPC ..... *B65H 2701/1311* (2013.01); *B65H 2701/1313* (2013.01); *B65H 2801/06* (2013.01)

(56) References Cited

U.S. PATENT DOCUMENTS

| | | | | |
|---|---|---|---|---|
| 6,702,274 | B1 * | 3/2004 | Otsuka | 271/10.01 |
| 6,923,437 | B2 * | 8/2005 | Huang et al. | 271/4.03 |
| 7,178,914 | B2 * | 2/2007 | Marra et al. | 347/104 |
| 7,296,794 | B2 * | 11/2007 | Shimazaki | 271/259 |
| 8,033,541 | B2 * | 10/2011 | Akiyama et al. | 271/10.03 |
| 8,047,529 | B2 * | 11/2011 | Fukasawa | 271/10.03 |
| 8,070,152 | B2 * | 12/2011 | Miwa et al. | 271/10.03 |
| 8,292,286 | B2 * | 10/2012 | Mizuno et al. | 271/4.03 |
| 8,439,346 | B2 * | 5/2013 | Fukasawa | 271/10.03 |
| 8,585,052 | B2 * | 11/2013 | Hirata et al. | 271/259 |
| 2004/0119224 | A1 * | 6/2004 | Otsuka | 271/10.03 |
| 2009/0153922 | A1 * | 6/2009 | Murrell et al. | 358/505 |
| 2011/0285076 | A1 * | 11/2011 | Fujiwara et al. | 271/186 |

FOREIGN PATENT DOCUMENTS

| | | | |
|---|---|---|---|
| JP | 10-153893 | A | 6/1998 |
| JP | 11322131 | A | 11/1999 |
| JP | 2000-327177 | A | 11/2000 |
| JP | 2001039552 | A | 2/2001 |
| JP | 2005-047697 | A | 2/2005 |
| JP | 2007-161479 | A | 6/2007 |

* cited by examiner

SHEET FEEDING DEVICE, CONTROL METHOD FOR THE SHEET FEEDING DEVICE, AND IMAGE FORMING APPARATUS INCORPORATING THE SHEET FEEDING DEVICE

CROSS-REFERENCE TO RELATED APPLICATIONS

This patent application is based on and claims priority pursuant to 35 U.S.C. §119 to Japanese Patent Application No. 2010-275927, filed on Dec. 10, 2010 in the Japanese Patent Office, the entire disclosure of which is hereby incorporated by reference herein.

FIELD OF THE INVENTION

The present invention relates to a sheet feeding device that feeds a sheet of recording media, a control method for controlling the sheet feeding device, and an image forming apparatus including the sheet feeding device.

BACKGROUND OF THE INVENTION

Conventionally, sheet feeding device provided in an image forming apparatus, such as a copier, a printer, a facsimile machine, or a multifunction machine having these functions, is configured to use a registration sensor to detect a feed failure jam caused by a failure to supply a sheet to a sheet path. The registration sensor is provided in the vicinity of registration rollers for correcting skew of the fed sheet and positioning the sheet properly. If the registration sensor does not detect a sheet within a predetermined time after the start of a sheet feeding operation, it is determined that the sheet has been misfed.

In recent years, shorter intervals between sheets in a continuous print job is sought to deal with faster operating speeds and improved productivity. At the same time, however, if the trailing end of a preceding sheet is overtaken by the leading end of a subsequent sheet, the sheets are conveyed together. As a result, the registration sensor fails to turn off with predetermined timing, and thus a sheet jam occurs. To prevent the leading end of the subsequent sheet from overtaking the trailing end of the preceding sheet, therefore, it is desirable to check the state of the preceding sheet, such as the position and the presence or absence thereof, before the start of the sheet feeding operation.

In the background sheet feeding device described above, which detects a misfeed using the registration sensor, however, the state of the preceding sheet is not checked before the start of the sheet feeding operation. It is therefore difficult to feed sheets while preventing the preceding sheet and the subsequent sheet from coming into contact with each other and, at the same time, reducing the intervals between the sheets. Thus, it is difficult for the above-described configuration to deal with the increase in operating speed and the improvement in productivity of image forming apparatuses.

SUMMARY OF THE INVENTION

The present invention describes a novel sheet feeding device. In one example, a novel sheet feeding device includes a sheet storage unit, a sheet feeding roller, and a detector. The sheet storage unit stores a sheet of recording media. The sheet feeding roller is provided downstream from the sheet storage unit along a sheet conveyance path in a sheet conveyance direction to feed the sheet of recording media from the sheet storage unit to a destination. The detector detects the sheet at the destination. The detector operates to detect the sheet within a predetermined time after the start of preparation for a feeding operation of a sheet by the feeding device, and, if no sheet is detected, determine that the sheet is misfed. Further, the start of the feeding operation is varied depending on whether or not the detector detects a sheet already present at the destination.

The start of the feeding operation of a sheet may be delayed if the detector detects a sheet at the destination.

The preparation for the feeding operation may start after a trailing end of a sheet detected at the destination passes through a detection range of the detector if the detector detects a sheet at the destination.

The preparation for the feeding operation may start before a trailing end of a sheet detected at the destination passes through a detection range of the detector if the detector detects a sheet at the destination, to prevent the trailing end of the sheet from being overtaken by the leading end of the sheet fed immediately thereafter.

The detector may include a sensor feeler and a photointerrupter.

The detector may include a reflective sensor.

The above-described sheet feeding device may further include a sheet loading unit on which a sheet to be fed is loaded, and a second detector to detect the presence or absence of a sheet in the loading unit. The first detector may have a detection range that is different from the detection range of the second detector.

The sheet loading unit may be driven by a drive device to bring the sheet on the loading unit into contact with the feeding device and prepare the sheet for the feeding operation.

The present invention further describes a novel control method for a sheet feeding device. In one example, a novel control method for a sheet feeding device controls a sheet feeding device configured to determine that a sheet is misfed if a sheet is not detected at a destination within a predetermined time after the start of preparation for a feeding operation of feeding a sheet. The control method includes detecting, before the start of the feeding operation of a sheet, whether or not a sheet is standing by at the destination, and starting the feeding operation of a sheet at the time set in accordance with the result of the detection.

If the detecting does not detect a sheet standing by at the destination before the start of the feeding operation of a sheet, the starting may immediately start the preparation for the feeding operation of a sheet.

If the detecting detects a sheet standing by at the destination before the start of the feeding operation of a sheet, the starting may start the preparation for the feeding operation of a sheet after the trailing end of the detected sheet passes a detection position in the destination.

If the detecting detects a sheet standing by at the destination before the start of the feeding operation of a sheet, the starting may start the preparation for the feeding operation of a sheet at a time which is before the trailing end of the detected sheet passes a detection position in the destination, and which prevents the trailing end of the sheet from being overtaken by the leading end of the sheet fed immediately thereafter.

The present invention further describes a novel image forming apparatus. In one example, a novel image forming apparatus includes the above-described sheet feeding device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
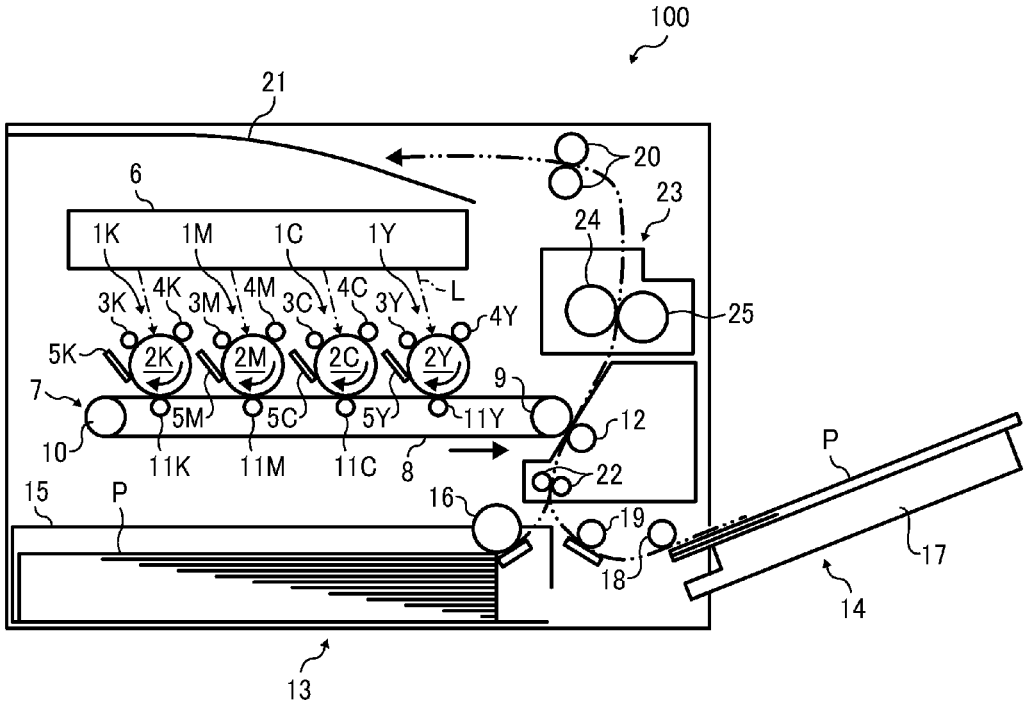
FIG. 1 is a schematic configuration diagram of an image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, the present invention will be described. In the drawings for explaining the present invention, constituent elements such as members or constituent components identified as having the same function or shape are assigned with the same reference numeral, and description thereof will be omitted after once given.

With reference to FIG. 1, a description will be first given of an overall configuration and operation of an image forming apparatus according to an embodiment of the present invention.

An image forming apparatus 100 illustrated in FIG. 1 is a color image forming apparatus including four image forming units 1Y, 1C, 1M, and 1K for yellow (Y), cyan (C), magenta (M), and black (K) colors corresponding to color separation components of a color image. The image forming units 1Y, 1C, 1M, and 1K are similar in configuration except for the difference in color of toners contained therein.

Specifically, the image forming units 1Y, 1C, 1M, and 1K include respective components such as photoconductors 2Y, 2C, 2M, and 2K, charging devices, development devices, and cleaning devices. Each of the photoconductors 2Y, 2C, 2M, and 2K serves as an image carrying member. The charging devices include, for example, charging rollers 3Y, 3C, 3M, and 3K for charging the outer circumferential surfaces of the photoconductors 2Y, 2C, 2M, and 2K, respectively. The development devices include, for example, development rollers 4Y, 4C, 4M, and 4K for supplying the surface of the photoconductors 2Y, 2C, 2M, and 2K, respectively, with respective developers including toner. The cleaning devices include, for example, cleaning blade 5Y, 5C, 5M, and 5K for cleaning the surfaces of the photoconductors 2Y, 2C, 2M, and 2K, respectively.

Above the image forming units 1Y, 1C, 1M, and 1K, an exposure device 6 is provided, which serves as an exposure device that exposes the respective surfaces of the photoconductors 2Y, 2C, 2M, and 2K to light. The exposure device 6 includes, for example, light sources, polygon mirrors, f-q lenses, and reflecting mirrors, and applies laser light beams L to the surfaces of the photoconductors 2Y, 2C, 2M, and 2K on the basis of image data.

Below the image forming units 1Y, 1C, 1M, and 1K, a transfer device 7 is provided, which includes an intermediate transfer belt 8 formed by an endless belt serving as a transfer member. The intermediate transfer belt 8 is wound around and stretched between a drive roller 9 and a driven roller 10 serving as support members. The drive roller 9 is driven to rotate by a drive source. With the drive roller 9 rotating in the counterclockwise direction in the drawing, the intermediate transfer belt 8 circularly moves, i.e., rotates in the direction indicated by the corresponding arrow in the drawing.

Four primary transfer rollers 11Y, 11C, 11M, and 11K serving as a primary transfer device are provided at respective positions facing the four photoconductors 2Y, 2C, 2M, and 2K. The primary transfer rollers 11Y, 11C, 11M, and 11K press the inner circumferential surface of the intermediate transfer belt 8 at the respective positions thereof. Primary transfer nips are formed at respective positions at which the pressed portions of the intermediate transfer belt 8 and the photoconductors 2Y, 2C, 2M, and 2K come into contact with each other. Each of the primary transfer rollers 11Y, 11C, 11M, and 11K is connected to a power supply, and is applied with at least one of a predetermined direct-current (DC) voltage and a predetermined alternating-current (AC) voltage.

A secondary transfer roller 12 serving as a secondary transfer device is provided at a position facing the drive roller 9. The secondary transfer roller 12 presses the outer circumferential surface of the intermediate transfer belt 8, and a secondary transfer nip is formed at a position at which the secondary transfer roller 12 and the intermediate transfer belt 8 come into contact with each other. Similarly to the primary transfer rollers 11Y, 11C, 11M, and 11K, the secondary transfer roller 12 is connected to a power supply, and is applied with at least one of a predetermined direct-current (DC) voltage and a predetermined alternating-current (AC) voltage.

In a lower part of the image forming apparatus 100, a sheet feeding device 13 and a manual sheet feeding device 14 serving as sheet feeding devices are provided. The sheet feeding device 13 includes, for example, a sheet feeding cassette 15 serving as a sheet storage unit that stores a sheet-like recording medium P, such as a paper sheet or an overhead projector (OHP) sheet, and a sheet feeding roller 16 serving as a feeding device that feeds the recording medium P from the sheet feeding cassette 15. The manual sheet feeding device 14 includes, for example, a manual feeding tray 17 serving as a loading unit on which the recording medium P is loaded, and a pickup roller 18 and a sheet feeding roller 19 serving as feeding devices that feed the recording medium P from the manual feeding tray 17.

On a recording medium conveying path extending from the sheet feeding cassette 15 or the manual feeding tray 17 to the secondary transfer nip between the secondary transfer roller 12 and the intermediate transfer belt 8, a pair of registration rollers 22 is provided that correct the skew of the recording medium P and adjust the timing of conveyance. On the downstream side of the secondary transfer nip in the recording medium conveying direction, a fixing device 23 and a pair of sheet discharging rollers 20 are provided in this order. The fixing device 23 fixes an image on the recording medium P, and the sheet discharging rollers 20 discharge the recording medium P to a sheet discharge tray 21. Herein, the fixing device 23 includes a fixing roller 24 including therein a heat source and a pressure roller 25 brought into pressure contact with the fixing roller 24.

With reference to FIG. 1, a basic operation of the above-described image forming apparatus 100 will now be described. When an image forming operation starts, the respective photoconductors 2Y, 2C, 2M, and 2K of the image forming units 1Y, 1C, 1M, and 1K are driven to rotate in the clockwise direction in the drawing, and the respective surfaces of the photoconductor 2Y, 2C, 2M, and 2K are uniformly charged to a predetermined polarity by the respective charging rollers 3Y, 3C, 3M, and 3K. On the basis of image information of a document read by a reading device, the laser light L is applied to the charged surfaces of the photoconductors 2Y, 2C, 2M, and 2K by the exposure device 6, and electrostatic latent images are formed on the surfaces of the photoconductor 2Y, 2C, 2M, and 2K. Herein, the image information used in the exposure of the photoconductors 2Y, 2C, 2M, and 2K is image information of single colors obtained by separation of a desired full-color image into yellow, cyan, magenta, and black color information components. The electrostatic latent images thus formed on the photoconductors 2 are supplied with the respective toners by the development rollers 4, and thereby are visualized as toner images, i.e., developed into visible images.

The drive roller 9 stretching the intermediate transfer belt 8 is driven to rotate, and the intermediate transfer belt 8 circularly moves in the direction indicated by the corresponding arrow in the drawing. Further, the primary transfer rollers 11Y, 11C, 11M, and 11K are applied with a constant voltage or a constant current-controlled voltage having a polarity opposite to a toner charging polarity. Thereby, transfer electric fields are formed in the primary transfer nips between the primary transfer rollers 11Y, 11C, 11M, and 11K and the photoconductors 2Y, 2C, 2M, and 2K. Then, the toner images of the respective colors on the photoconductors 2Y, 2C, 2M, and 2K are sequentially superimposed and transferred onto the intermediate transfer belt 8 by the transfer electric fields formed in the primary transfer nips. Thereby, the intermediate transfer belt 8 carries a full-color toner image on the surface thereof. Residual toners on the photoconductors 2Y, 2C, 2M, and 2K having failed to be transferred to the intermediate transfer belt 8 are removed by the cleaning blades 5Y, 5C, 5M, and 5K.

Further, when the image forming operation starts, the recording medium P is fed from the sheet feeding cassette 15 or the manual feeding tray 17. The fed recording medium P is sent to the secondary transfer nip between the secondary transfer roller 12 and the intermediate transfer belt 8 by the registration rollers 22 with appropriate timing. In this process, the secondary transfer roller 12 is applied with a transfer voltage having a polarity opposite to the toner charging polarity of the toner image on the intermediate transfer belt 8. Thereby, a transfer electric field is formed in the secondary transfer nip. Then, the toner images on the intermediate transfer belt 8 are transferred at one time onto the recording medium P by the transfer electric field formed in the secondary transfer nip. Residual toners remaining on the intermediate transfer belt 8 after the image transfer operation are removed by a belt cleaning device. Thereafter, the recording medium P is sent to the fixing device 23. When the recording medium P passes through a fixing nip formed by pressure contact between the fixing roller 24 and the pressure roller 25, the toner image is fixed on the recording medium P by heat and pressure applied thereto. The recording medium P is then discharged to the sheet discharge tray 21 by the pair of sheet discharging rollers 20.

The above description is of the image forming operation for forming a full-color image on the recording medium P. It is also possible to form a single-color image by using one of the four image forming units 1Y, 1C, 1M, and 1K, and to form an image of two or three colors by using two or three of the image forming units 1Y, 1C, 1M, and 1K.

Figure 2:
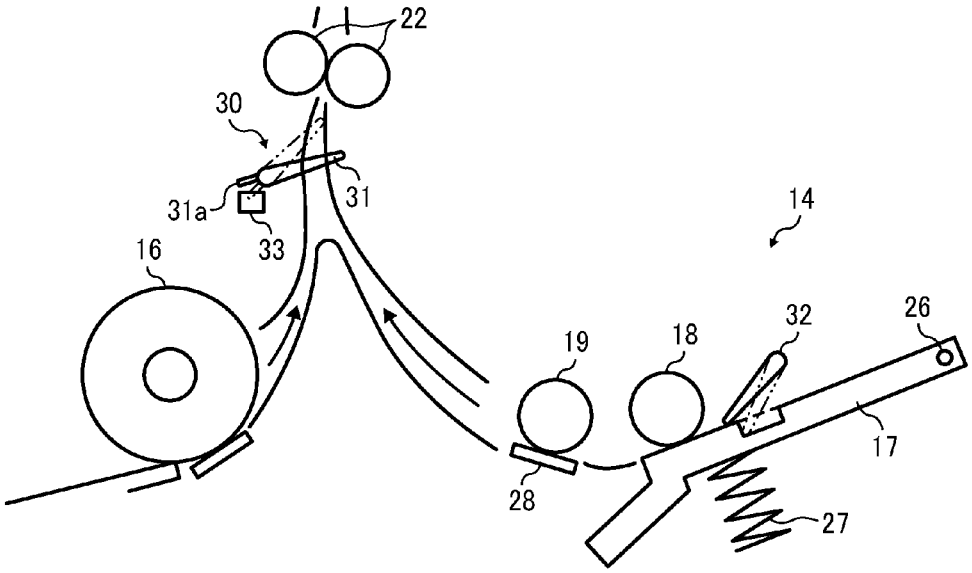
FIG. 2 is a side view illustrating a schematic configuration of a manual sheet feeding device provided in the image forming apparatus.
Figure 3:
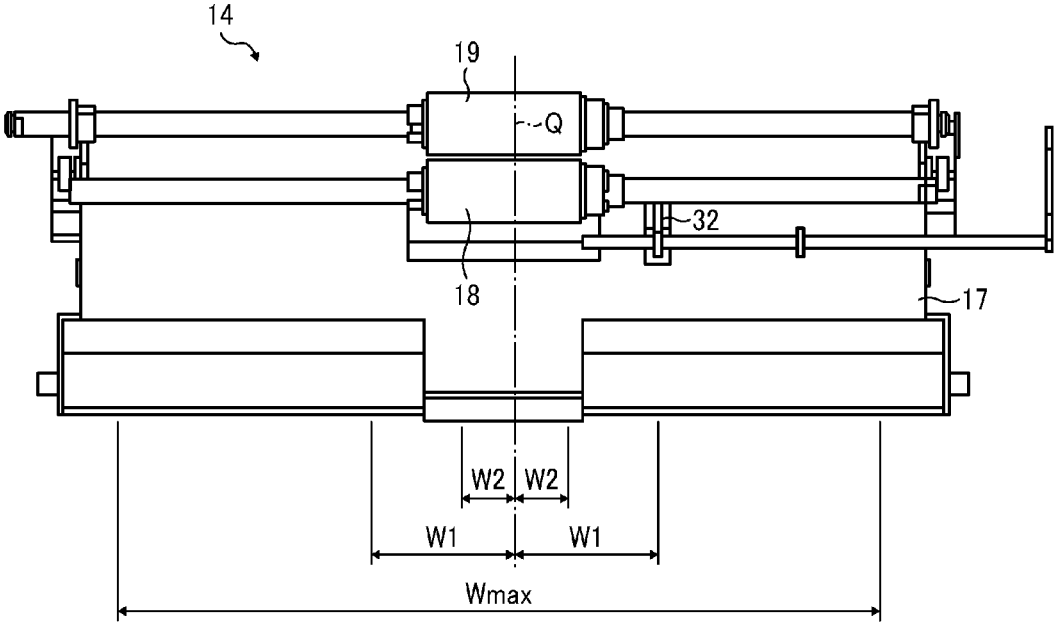
FIG. 3 is a plan view of the manual sheet feeding device.

A configuration and operation of the above-described manual sheet feeding device 14 will now be described in detail. FIG. 2 is a side view illustrating a schematic configuration of the manual sheet feeding device 14, and FIG. 3 is a plan view of the manual sheet feeding device 14.

As illustrated in FIG. 2, the manual feeding tray 17 is configured to be rotatable around a fulcrum 26, and is selectively moved up and down by a drive device including, for example, solenoids, gears, and cam mechanisms. Alternatively, if the manual feeding tray 17 is configured to be moved up and down not by the drive device including, for example, solenoids, gears, and cam mechanisms, but by a special drive device such as a motor, noise such as impact sound generated in a connecting operation accompanying the driving is reduced.

The manual feeding tray 17 is constantly biased in the direction of the pickup roller 18 by a pressure spring 27 serving as a biasing device. When the image forming operation starts with recording media P placed on the manual feeding tray 17, the manual feeding tray 17 is lifted by the drive device, and the recording media P are brought into contact with the pickup roller 18. In this state, the pickup roller 18 starts rotating. Thereby, the recording media P are fed toward the sheet feeding roller 19. Then, each of the recording media P is separated from the other recording media P by the rotating sheet feeding roller 19 and a separating member 28 facing the sheet feeding roller 19, and is fed toward the registration rollers 22.

On the upstream side of the registration rollers 22 in the recording medium conveying direction, i.e., on one side of the registration rollers 22 closer to the sheet feeding roller 19, a registration sensor 30 is provided which serves as a detector that detects the recording medium P. The registration sensor 30 is configured to include a sensor feeler (hereinafter referred to as registration feeler) 31 and a transmissive photointerrupter 33. When the recording medium P fed by the sheet feeding roller 19 comes into contact with the registration feeler 31, the leading end of the registration feeler 31 swings. According to this action, a projecting portion 31*a* disposed at the root end of the registration feeler 31 blocks the light of the transmissive photointerrupter 33, and thereby allows the registration sensor 30 to detect the arrival of the leading end of the recording medium P. The rotation of the registration rollers 22 is controlled on the basis of the result of detection by the registration sensor 30, and the recording medium P is conveyed to the secondary transfer nip with appropriate timing.

Further, a sensor feeler 32 serving as a detector that detects the presence or absence of the recording medium P is provided on the manual feeding tray 17. As illustrated in FIG. 3, the sensor feeler 32 is provided at a position offset from a center Q of the manual feeding tray 17 laterally, that is, in the recording medium width direction, by a distance W1 in the width direction. In this case, therefore, the width of the recording medium P detectable by the sensor feeler 32 on the manual feeding tray 17 ranges from approximately 2'W1 to approximately a maximum width Wmax of the recording medium P.

Meanwhile, the registration feeler 31 of the registration sensor 30 is provided at a position offset laterally from the center Q in the recording medium width direction by a distance W2 in the width direction. That is, the registration feeler 31 is provided at a position closer to the center Q in the recording medium width direction than the sensor feeler 32 on the manual feeding tray 17 is. The registration feeler 31 of the registration sensor 30 in the present embodiment is thus provided at a position at which the recording medium P having a width undetectable by the sensor feeler 32 on the manual feeding tray 17 (i.e., a width equal to or more than approximately 2'W2 and less than approximately 2'W1) is detectable.

Figure 4:
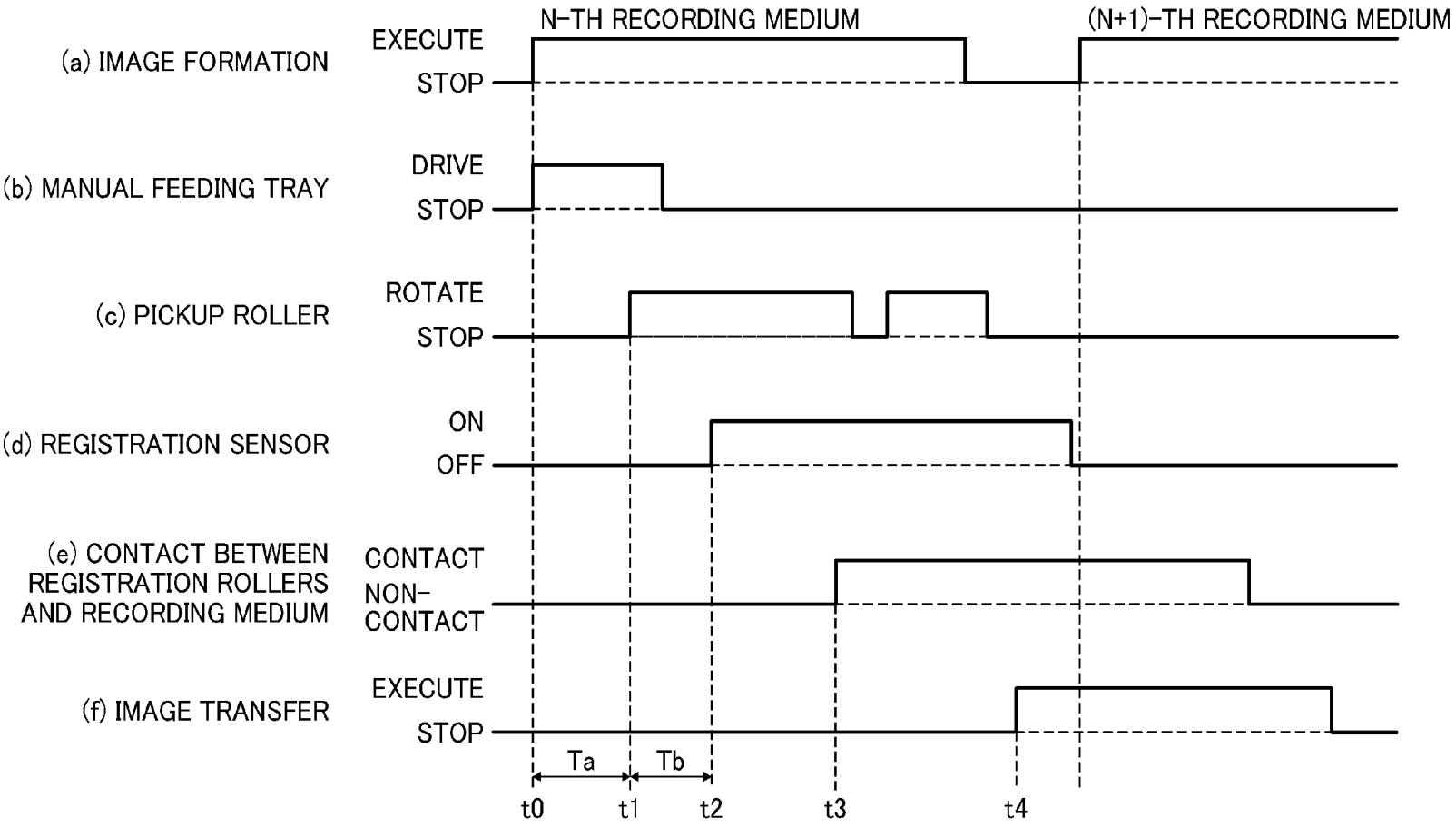
FIGS. 4(*a*) to 4(*f*) are diagrams illustrating a timing chart of operations from the start of an image forming operation to the completion of an image transfer operation.
Figure 6:
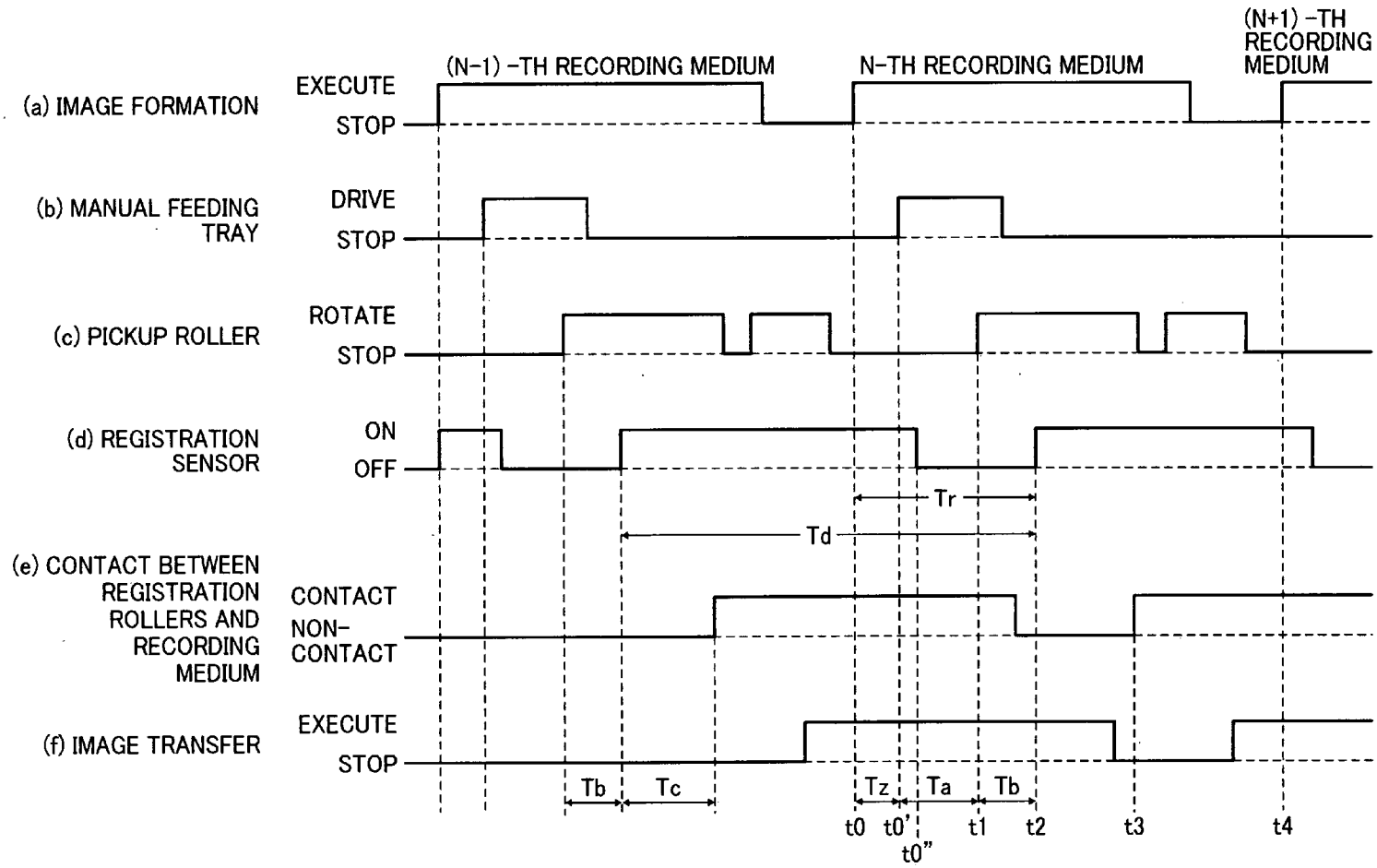
FIGS. 6(*a*) to 6(*f*) are diagrams illustrating still another timing chart of the operations.

FIGS. 4(*a*) to 4(*f*) to FIGS. 6(*a*) to 6(*f*) are diagrams illustrating timing charts of operations from the start of the image forming operation to the completion of the image transfer operation in the present embodiment.

A description will be first given of the timing chart illustrated in FIGS. 4(*a*) to 4(*f*). In FIGS. 4(*a*) to 4(*f*), at a time point t0 corresponding to the start of the image forming operation of the N-th recording medium P in the image forming units 1Y, 1C, 1M, and 1K illustrated in FIG. 4(*a*), the registration sensor 30 illustrated in FIG. 4(*d*) is not detecting the preceding (N−1)-th recording medium P. In this case, there is little possibility that the leading end of the N-th recording medium P will overtake the trailing end of the preceding (N−1)-th recording medium P. Therefore, the lifting operation of the manual feeding tray 17 illustrated in FIG. 4(*b*) is immediately started at the time point t0. After the lifting operation of the manual feeding tray 17 is started and the recording medium P on the manual feeding tray 17 comes into contact with the pickup roller 18, the rotation of the pickup roller 18 illustrated in FIG. 4(*c*) is started at a time point t1, to thereby start feeding the recording medium P. Then, the registration sensor 30 illustrated in FIG. 4(*d*) turns on at a time point t2, and thereby the recording medium P is detected. The recording medium P then comes into contact with the registration rollers 22 at a time point t3, as illustrated in FIG. 4(*e*). Thereafter, the rotation of the registration rollers 22 is started in appropriate timing with the formed image, and the recording medium P is conveyed to a transfer position, i.e., the secondary transfer nip. Then, the image transfer operation is started at a time point t4, as illustrated in FIG. 4(*f*).

Further, in the above-described timing chart of FIGS. 4(*a*) to 4(*f*), if the registration sensor 30 does not turn on after the lapse of a predetermined time Tx since the start of the lifting operation of the manual feeding tray 17 illustrated in FIG. 4(*b*), i.e., since the time point t0, and if the corresponding recording medium P is the first sheet of a print job, it is determined that there is no recording medium P set on the manual feeding tray 17. If the registration sensor 30 does not turn on after the lapse of the predetermined time Tx since the start of the lifting operation of the manual feeding tray 17, and if a continuous print job is being executed, it is determined that the recording media P have run out. Then, a notification of absence of a recording medium P is issued.

The predetermined time Tx for determining the presence or absence of a recording medium P is set by the following formula (1):

$$Tx=Ta+Tb+Tk1 \quad (1)$$

In the above formula (1), Ta represents the theoretical time from the start of the lifting operation of the manual feeding tray 17 at the time point t0 to the start of the rotation of the pickup roller 18 at the time point t1. Further, Tb represents the theoretical time from the start of the rotation of the pickup roller 18 at the time point t1 to the detection of the recording medium P by the registration sensor 30 at the time point t2. Further, Tk1 represents a margin time for a case where the feeding operation of the recording medium P is delayed owing to slipping thereof occurring in the time from the start of the feeding operation at the time point t1 to the detection of the recording medium P by the registration sensor 30 at the time point t2.

Subsequently, the timing chart illustrated in FIGS. 5(*a*) to 5(*f*) will be described. Unlike FIGS. 4(*a*) to 4(*f*), in FIGS. 5(*a*) to 5(*f*), at the time point t0 corresponding to the start of the image forming operation of the N-th recording medium P in the image forming units 1Y, 1C, 1M, and 1Bk illustrated in FIG. 5(*a*), the registration sensor 30 illustrated in FIG. 5(*d*) is detecting the preceding (N−1)-th recording medium P. In this case, to prevent the leading end of the N-th recording medium P from overtaking the trailing end of the preceding (N−1)-th recording medium P, the lifting operation of the manual feeding tray 17 illustrated in FIG. 5(*b*) is started at a time point t0' at which the trailing end of the preceding (N−1)-th recording medium P passes a detection position of the registration sensor 30 and the registration sensor 30 turns off. The timing of the respective subsequent operations is basically similar to that of FIGS. 4(*a*) to 4(*f*). However, the start of the feeding operation by the pickup roller 18 corresponding to the time point t1 and the respective start times of the subsequent operations corresponding to the time points t2 to t4 are delayed by the time corresponding to the delay of the start of the lifting operation of the manual feeding tray 17 from the time point t0 to the time point t0'.

Figure 5:
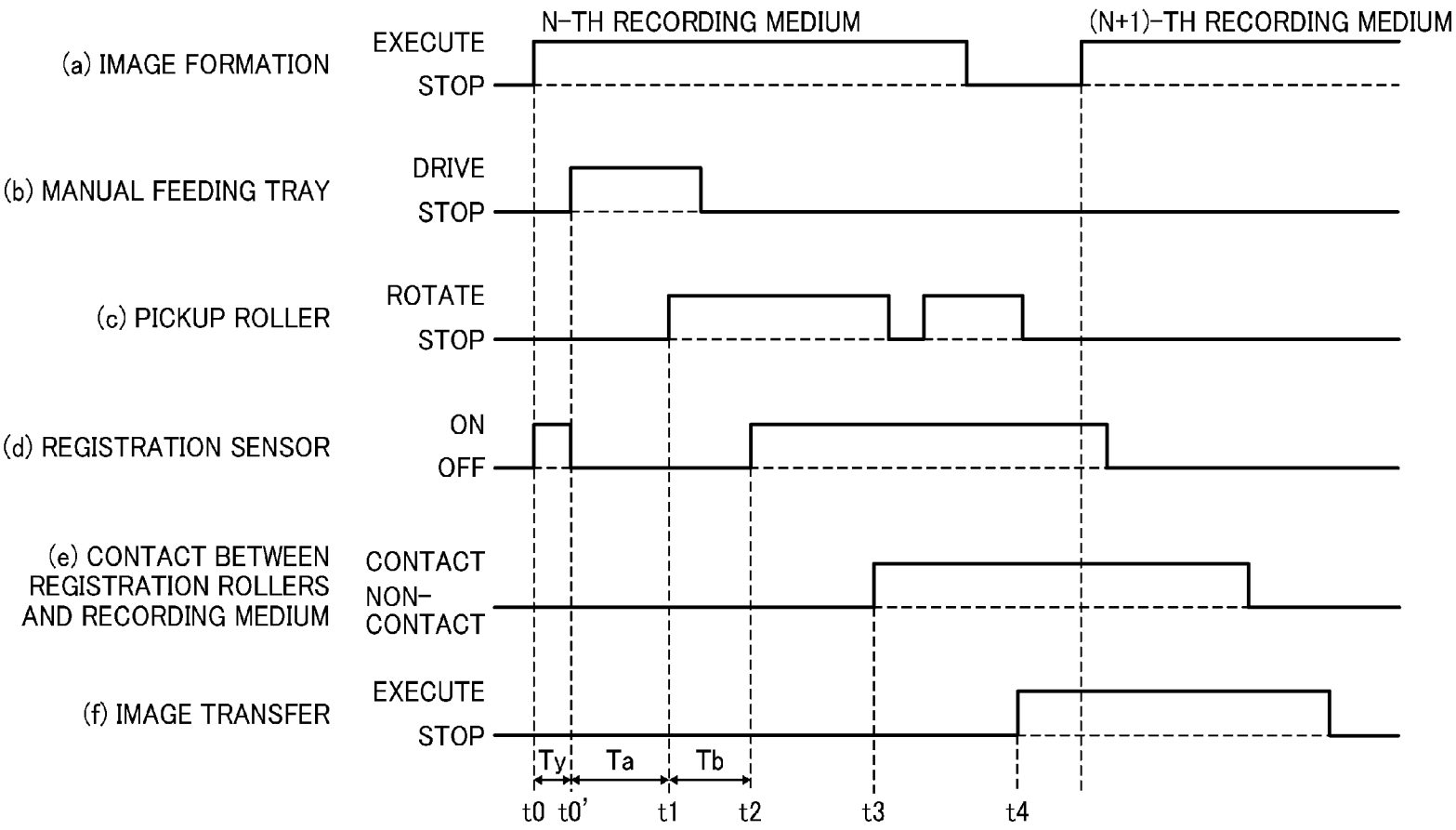
FIGS. 5(*a*) to 5(*f*) are diagrams illustrating another timing chart of the operations.

Also in this case, if the registration sensor 30 does not turn on after the lapse of the predetermined time Tx since the start of the lifting operation of the manual feeding tray 17 illustrated in FIG. 5(*b*), i.e., since the time point t0', it is determined that there is no recording medium P set on the manual feeding tray 17 or that the recording media P have run out, and a notification of absence of a recording medium P is issued.

In this case, the predetermined time Tx for determining the presence or absence of a recording medium P is set by the following formula (2):

$$Tx=Ty+Ta+Tb+Tk1 \quad (2)$$

In the above formula (2), Ty represents the time from the start of the image forming operation of the N-th recording medium P at the time point t0 to the completion of detection of the preceding (N−1)-th recording medium P by the registration sensor 30 at the time point t0', i.e., a standby time for preventing the leading end of the N-th recording medium P from overtaking the trailing end of the preceding (N−1)-th recording medium P. Further, similarly as in the formula (1), Ta represents the theoretical time from the start of the lifting operation of the manual feeding tray 17 at the time point t0' to the start of the rotation of the pickup roller 18 at the time point t1. Further, Tb represents the theoretical time from the start of the rotation of the pickup roller 18 at the time point t1 to the detection of the recording medium P by the registration sensor 30 at the time point t2. Further, Tk1 represents a margin time for a case where the feeding operation of the recording medium P is delayed owing to slipping thereof occurring in the time from the start of the feeding operation at the time point t1 to the detection of the recording medium P by the registration sensor 30 at the time point t2.

As described above, in the timing chart illustrated in FIGS. 5(*a*) to 5(*f*), if the preceding recording medium P is being detected by the registration sensor 30, the feeding operation of the immediately following recording medium P is started after the completion of the detection by the registration sensor 30. However, it is also possible to start the feeding operation of the recording medium P before the completion of the detection by the registration sensor 30. FIGS. 6(*a*) to 6(*f*) illustrate a timing chart of that case.

In FIGS. 6(*a*) to 6(*f*), even during the time from the time point t0 to a time point t0" in which the registration sensor 30 is detecting the preceding (N−1)-th recording medium P, the lifting operation of the manual feeding tray 17 is started at the time point t0' after the lapse of a time Tz since the time point t0 corresponding to the start of the image forming operation, to thereby start preparation for the feeding operation of the N-th recording medium P. The time Tz is long enough to prevent the leading end of the N-th recording medium P from overtaking the trailing end of the preceding (N−1)-th recording medium P. Theoretically, the standby time Tz for preventing the N-th recording medium P from overtaking the preceding (N−1)-th recording medium P is calculated by the following formula (3):

$$Tz^3 Tr-Td+L/V-(Tb+Tc+Tk2) \quad (3)$$

In the above formula (3), Tr represents the time from the start of the image forming operation of the N-th recording medium P at the time point t0 to the detection of the N-th recording medium P by the registration sensor 30 at the time point t2. Further, Td represents the time from the detection of the (N−1)-th recording medium P by the registration sensor 30 to the detection of the N-th recording medium P at the time point t2. Further, L represents the length of each recording medium P in the conveying direction, and V represents the recording medium conveying velocity. Further, Tb+Tc represents the time from the start of the feeding operation of the (N−1)-th recording medium P by the pickup roller 18 to the arrival of the (N−1)-th recording medium P to the registration rollers 22, and Tk2 represents a margin time in consideration of slipping of the (N−1)-th recording medium P.

With the use of the above set formula (3), the time from the start of the image forming operation of the N-th recording medium P to the passage of the trailing end of the preceding (N−1)-th recording medium P through the pickup roller 18 is calculated. The feeding operation of the N-th recording medium P is started after the lapse of the calculated time. Thereby, the interval between the trailing end of the (N−1)-th recording medium P and the leading end of the N-th recording medium P is secured.

Also in this case, if the registration sensor 30 does not turn on after the lapse of the predetermined time Tx since the start of the lifting operation of the manual feeding tray 17 illustrated in FIG. 6(*b*), i.e., since the time point t0', it is determined that there is no recording medium P set on the manual feeding tray 17 or that the recording media P have run out, and a notification of absence of a recording medium P is issued.

In this case, the predetermined time Tx is set by the following formula (4):

$$Tx=Tz+Ta+Tb+Tk1 \quad (4)$$

Herein, the times Tz, Ta, Tb, and Tk1 are similar to those described in the formulae (2) and (3).

If the time Tz of the formula (4) is expressed with the formula (3), the formula (4) is expressed as the following formula (5):

$$Tx=Tr-Td+L/V-(Tb+Tc+Tk2)+Ta+Tb+Tk1=Tr+Ta-Tc-Td+L/V+Tk1-Tk2 \quad (5)$$

Figure 7:
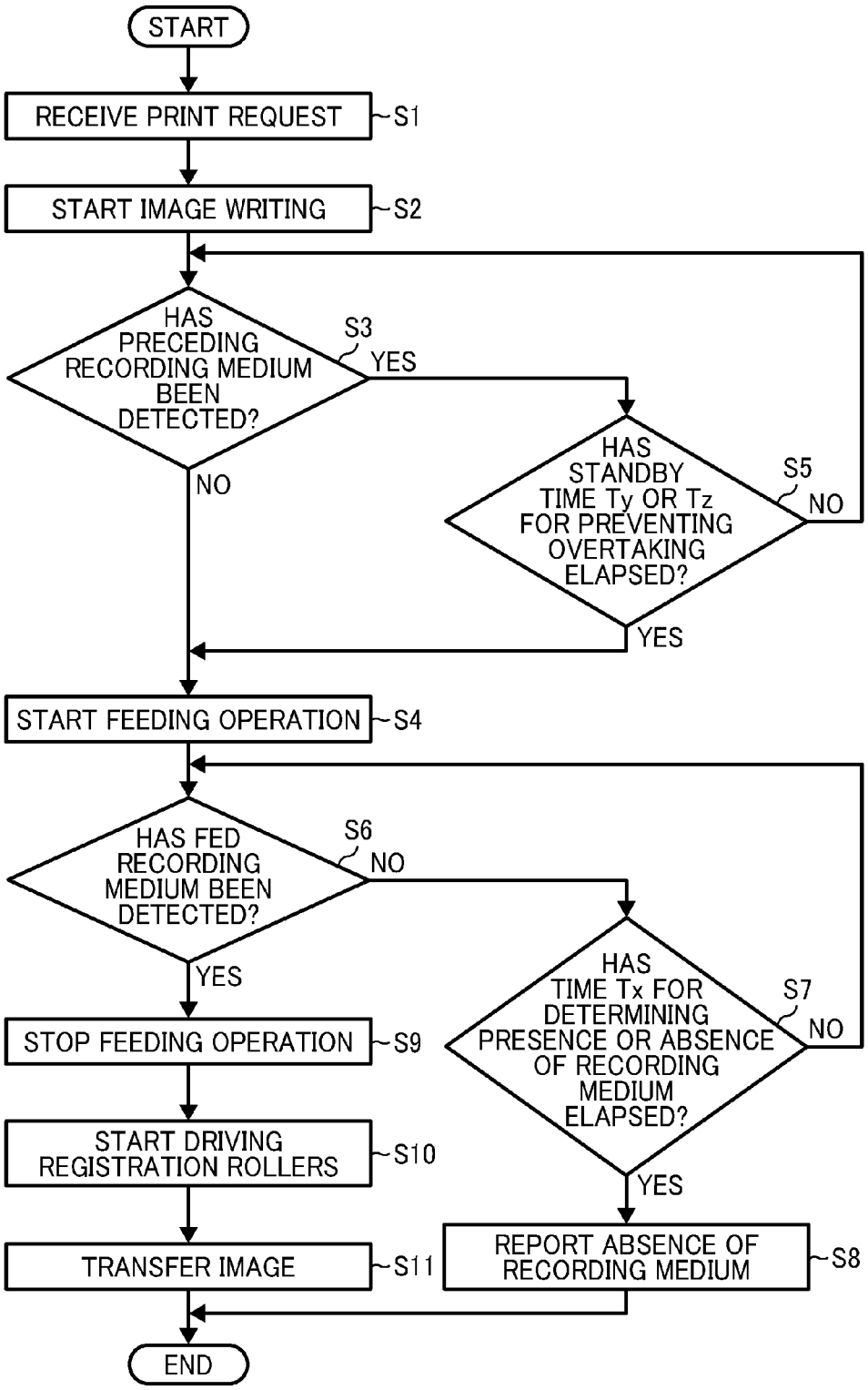
FIG. 7 is a diagram illustrating a flowchart of the operations from the start of the image forming operation to the completion of the image transfer operation.

FIG. 7 is a diagram illustrating a flowchart of the operations from the start of the image forming operation to the completion of the image transfer operation. As illustrated in FIG. 7, in the present embodiment, if a print request is received (step S1), the registration sensor 30 detects, after the start of an image writing operation (step S2) and before the start of the feeding operation of a recording medium P (step S4), the presence or absence of a preceding recording medium P standing by at the feeding destination (step S3). Then, if a preceding recording medium P standing by at the feeding destination is not detected (NO in step S3), there is little possibility that the trailing end of the preceding recording medium P will be overtaken by the leading end of the recording medium P that is going to be fed. Therefore, the feeding operation is immediately started (step S4). On the other hand, if a preceding recording medium P standing by at the feeding destination is detected (YES in step S3), the preparation for the feeding operation is started (step S4) after the lapse of the standby time Ty illustrated in FIGS. 5(*a*) to 5(*f*) or the standby time Tz illustrated in FIGS. 6(*a*) to 6(*f*) to prevent the subsequent recording medium P from overtaking the preceding recording medium P (step S5).

Further, after the start of the preparation for the feeding operation (NO in step S6), if the registration sensor 30 does not detect a recording medium P within the predetermined time Tx (YES in step S7), it is determined that there is no recording medium P on the manual feeding tray 17, and a notification of absence of a recording medium P is issued (step S8). On the other hand, if the registration sensor 30 detects a recording medium P within the predetermined time Tx (YES in step S6), the feeding operation is stopped (step S9). Thereafter, the registration rollers 22 start to be driven to convey the recording medium P to the transfer position, i.e., the secondary transfer nip (step S10), and the image is transferred to the recording medium P (step S11).

As described above, in the present embodiment, the registration sensor 30 detects the presence or absence of a preceding recording medium P standing by at the feeding destination. Further, if a preceding recording medium P standing by is not detected, the preparation for the feeding operation, i.e., the lifting operation of the manual feeding tray 17 is immediately started. Thereby, the feeding operation is started at a relatively early time. Further, if a preceding recording medium P standing by at the feeding destination is detected, the preparation for the feeding operation may be started after the trailing end of the preceding recording medium P passes the detection position of the registration sensor 30, thereby preventing the preceding recording medium P from being overtaken by the subsequent recording medium P. Further, the standby time for preventing the subsequent recording medium P from overtaking the preceding recording medium P may be set to the minimum time Tz, thereby allowing the feeding operation to start even before the trailing end of the preceding recording medium P passes the detection position of the registration sensor 30. Accordingly, it is possible to advance the feeding start while at the same time preventing the subsequent recording medium P from overtaking the preceding recording medium P.

As described above, according to the present invention, the start of the feeding operation is changed in accordance with the presence or absence of a preceding recording medium P standing by at the feeding destination. Thereby, the subsequent recording medium P is prevented from overtaking the preceding recording medium P and causing a jam, and the start of the feeding operation is advanced as compared with before. Accordingly, it is possible to provide a device dealing with the increase in operating speed and the improvement in productivity of image forming apparatuses. Further, with the advance of the start of the feeding operation, the subsequent detection of the presence or absence of a recording medium P by the registration sensor 30 or detection of whether or not a recording medium P is normally fed, such as detection of a jam, is also allowed to take place at a relatively early time.

The above-described embodiment uses a registration sensor including a sensor feeler and a transmissive photointerrupter in consideration of reduction in cost. However, the registration sensor may also be constructed of a reflective sensor. In that case, the time required for the movement of the sensor feeler necessary for ON and OFF of the detection of a recording medium is saved. It is therefore possible to advance the time of detection of the trailing end of the preceding recording medium, and to start the feeding operation earlier. Further, it is possible to detect whether or not a recording medium is normally fed by using a detector other than the registration sensor.

Further, the configuration and the control device according to the embodiment of the present invention are applicable not only to the feeding device that feeds a recording medium but also to a document feeding device that feeds a document and a sheet feeding device that feeds other types of sheets. Further, the image forming apparatus including the sheet feeding device according to the embodiment of the present invention is not limited to that illustrated in FIG. 1, and may be another image forming apparatus, such as a copier, a printer, a facsimile machine, or a multifunction machine having these functions.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus, comprising:

a plurality of image forming units;

a transfer device being of an intermediate transfer type image forming apparatus in which toner images formed on an intermediate belt are transferred thereon;

a transfer roller facing the intermediate belt and forming a nip at a position at which the transfer roller and the intermediate belt come into contact with each other, wherein a transfer electric field is formed in the transfer nip at which the toner images on the intermediate belt are transferred at one time onto a sheet of recording media by the transfer electric field formed in the transfer nip; and a sheet feeding device, including:

a sheet storage unit that stores the sheet of recording media;

a sheet feeding roller provided downstream from the sheet storage unit along a sheet conveyance path in a sheet conveyance direction to feed the sheet of recording media from the sheet storage unit to a destination;

a first detector to detect the sheet at the destination, the first detector operating to detect the sheet within a set time after the start of preparation for a feeding operation of a sheet by the feeding device, and, if no sheet is detected, determine that the sheet is misfed, wherein the start of the feeding operation is varied depending on whether or not the first detector detects a sheet already present at the destination;

a sheet loading unit on which a sheet to be fed is loaded; and a second detector to detect the presence or absence of a sheet in the loading unit, wherein the first detector is positioned at a distance W2 from a substantial center of the sheet widthwise center, the second detector is positioned at a distance W1 from the substantial sheet widthwise center, the distance W1 is more than the distance W2 (W1>W2), and when presence of the sheet in the sheet loading unit is to be detected, the second detector detects the sheet with a width more than W2×2 and less than W1×2.

2. The image forming apparatus according to claim 1, wherein the start of the feeding operation of a sheet is delayed if the first detector detects a sheet at the destination.

3. The image forming apparatus according to claim 1, wherein the preparation for the feeding operation starts after a trailing end of a sheet detected at the destination passes through a detection range of the first detector if the first detector detects a sheet at the destination.

4. The image forming apparatus according to claim 1, wherein the preparation for the feeding operation starts before a trailing end of a sheet detected at the destination passes through a detection range of the first detector if the first detector detects a sheet at the destination, to prevent the trailing end of the sheet from being overtaken by the leading end of the sheet fed immediately thereafter.

5. The image forming apparatus according to claim 1, wherein the first detector comprises:

a sensor feeler; and a photointerrupter.

6. The image forming apparatus according to claim 1, wherein the first detector includes a reflective sensor.

7. The image forming apparatus according to claim 1, wherein the sheet loading unit is driven by a drive device to bring the sheet on the loading unit into contact with the feeding device and prepare the sheet for the feeding operation.

8. The image forming apparatus according to claim 1, wherein when the first detector does not detect a sheet width of more than W2×2 and less than W1×2 within a set time after the lifting operation of the feeding tray is started, a notification of absence of a recording medium is issued.

9. A control method for an image forming apparatus including a plurality of image forming units;

a transfer device being of an intermediate transfer type image forming apparatus in which toner images formed on an intermediate belt are transferred thereon;

a transfer roller facing the intermediate belt and forming a nip at a position at which the transfer roller and the intermediate belt come into contact with each other, wherein a transfer electric field is formed in the transfer nip at which the toner images on the intermediate belt are transferred at one time onto a sheet of recording media by the transfer electric field formed in the transfer nip; and a sheet feeding device configured to determine that a sheet is misfed if a sheet is not detected at a destination within a set time after the start of preparation for a feeding operation of feeding a sheet, the control method comprising:

detecting, via a first detector, before the start of the feeding operation of a sheet, whether or not a sheet is standing by at the destination;

starting the feeding operation of a sheet at the time set in accordance with the result of the detection;

loading the sheet to be fed; and detecting, via a second detector, the presence or absence of a sheet, wherein the first detector is positioned at a distance W2 from a substantial center of the sheet widthwise center, the second detector is positioned at a distance W1 from the substantial sheet widthwise center, the distance W1 is more than the distance W2 (W1>W2), and when presence of the sheet in a feeding tray is to be detected, the second detector detects the sheet with a width more than W2×2 and less than W1×2.

10. The control method for a sheet feeding device according to claim 9, wherein, if the detecting does not detect a sheet standing by at the destination before the start of the feeding operation of a sheet, the starting immediately starts the preparation for the feeding operation of a sheet.

11. The control method for a sheet feeding device according to claim 9, wherein, if the detecting detects a sheet standing by at the destination before the start of the feeding operation of a sheet, the starting starts the preparation for the feeding operation of a sheet after the trailing end of the detected sheet passes a detection position in the destination.

12. The control method for a sheet feeding device according to claim 9, wherein, if the detecting detects a sheet standing by at the destination before the start of the feeding operation of a sheet, the starting starts the preparation for the feeding operation of a sheet at a time which is before the trailing end of the detected sheet passes a detection position in the destination, and which prevents the trailing end of the sheet from being overtaken by the leading end of the sheet fed immediately thereafter.

13. The control method for a sheet feeding device according to claim 9, further comprising issuing a notification of absence of a recording medium when the first detector does not detect a sheet width of more than W2×2 and less than W1×2 within a set time after the lifting operation of the feeding tray is started.

* * * * *